US005791611A

United States Patent [19]

Battey et al.

[11] Patent Number: 5,791,611

[45] Date of Patent: Aug. 11, 1998

[54] HUB FOR CHAIR BASE

[75] Inventors: Robert J. Battey; Kurt R. Heidmann, both of Kentwood, Mich.

[73] Assignee: Steelcase Inc., Grand Rapids, Mich.

[21] Appl. No.: 693,784

[22] Filed: Aug. 9, 1996

[51] Int. Cl.[6] ..... F16M 11/20

[52] U.S. Cl. ..... 248/188.1; 403/370; 248/519; 248/412

[58] Field of Search ..... 297/451.5; 248/188.1, 248/188.7, 519, 523; 403/370, 368, 365

[56] References Cited

U.S. PATENT DOCUMENTS

| | | | |
|---|---|---|---|
| 559,943 | 5/1896 | Kent | 248/411 |
| 619,469 | 2/1899 | Ehrman . | |
| 642,235 | 1/1900 | Knape | 248/411 |
| 656,567 | 8/1900 | McKenzie . | |
| 689,855 | 12/1901 | Copeland . | |
| 1,854,932 | 4/1932 | Gottlieb . | |
| 1,970,624 | 8/1934 | Recker | 248/412 |
| 3,119,588 | 1/1964 | Keats | 248/519 X |
| 3,186,064 | 6/1965 | Buhrmaster . | |
| 3,281,105 | 10/1966 | Kafferlin et al. . | |
| 3,320,575 | 5/1967 | Brown et al. | 403/371 X |
| 3,328,976 | 7/1967 | Shoemaker et al. | 403/371 X |
| 3,705,704 | 12/1972 | Textoris . | |
| 3,737,136 | 6/1973 | Snurr . | |
| 3,741,514 | 6/1973 | Snurr . | |
| 3,908,946 | 9/1975 | George et al. . | |
| 4,253,632 | 3/1981 | Doerner . | |
| 4,324,382 | 4/1982 | Beukema et al. . | |
| 5,011,104 | 4/1991 | Fang | 248/412 X |
| 5,149,035 | 9/1992 | Bonnema et al. . | |
| 5,288,045 | 2/1994 | Edwards et al. . | |

*Primary Examiner*—Peter R. Brown
*Assistant Examiner*—Stephen Vu
*Attorney, Agent, or Firm*—Price, Heneveld, Cooper, DeWitt & Litton

[57] ABSTRACT

A chair base connection assembly for connecting a pipestand to a chair base includes an outer sleeve having opposing flared ends, an inner sleeve having a tapered inner diameter for engaging the pipestand and an outer surface having a taper at an upper end for engaging an inner flared surface at the upper end of the outer sleeve and external threads at the lower end for engaging a tapered intermediate nut having an outer flared surface which engages an inner flared surface on the lower end of the outer sleeve. The chair base connection assembly of this invention provides a stable, strong, wobble-free connection between the base and the pipestand, while allowing greater dimensional variability of the components comprising the chair base connection assembly, thereby reducing the manufacturing costs.

12 Claims, 1 Drawing Sheet

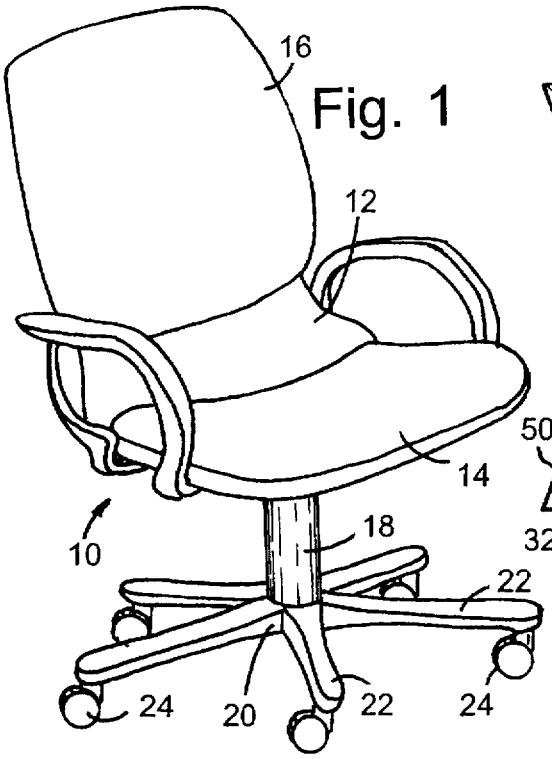
Fig. 1
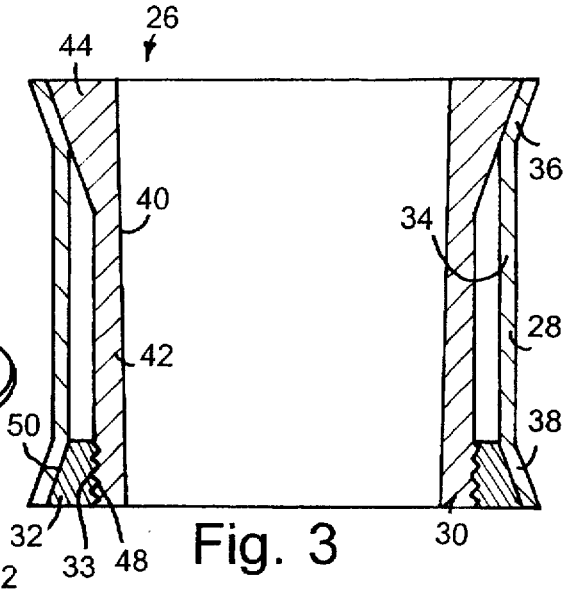
Fig. 3
Fig. 4
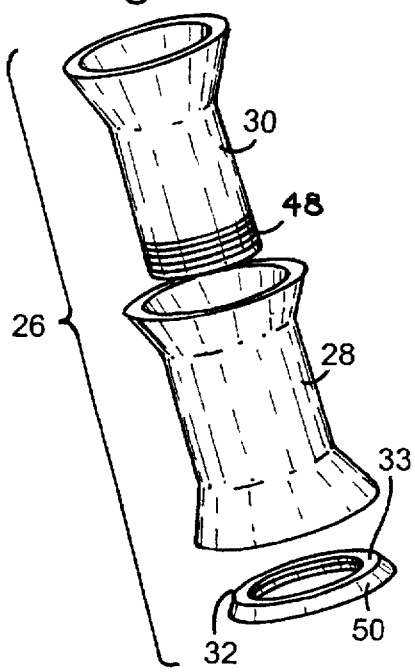
Fig. 2
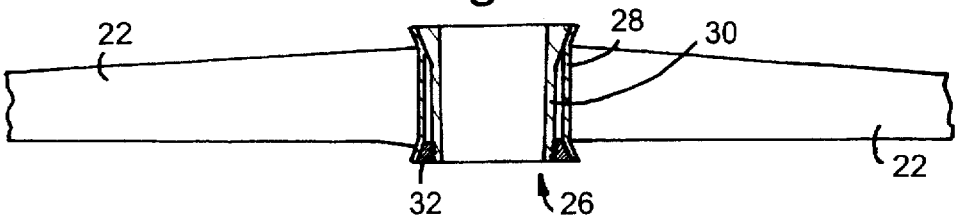

HUB FOR CHAIR BASE

FIELD OF THE INVENTION

This invention relates generally to chair bases and more particularly to a taper-fit chair base connection for securing a vertical standpipe, upon which seating members are mounted, to a base.

BACKGROUND OF THE INVENTION

Conventional taper-fit chair base connection assemblies rely on tight tolerances at the interface between the standpipe and the taper-fit base to provide locking action as the standpipe is merely inserted into the hub of the base. Reliance on maintaining close manufacturing tolerances to achieve locking action between a chair base and a standpipe generally requires precise machining of metal parts, which is relatively expensive. The overall cost of manufacturing chairs utilizing precision machined taper-fit components is further exacerbated by the fact that components which should not meet the required tolerances must often be scrapped. Accordingly, a relatively simple, inexpensive chair base connection assembly which does not require precision machining, and which includes components which can be mass produced such as by conventional molding techniques, which still providing excellent durability, stability, and secure, wobble-free attachment of a standpipe to a chair base, would be desirable.

Fang (U.S. Pat. No. 5,011,104) describes a telescopically adjustable stand including an outer tubular member and an inner cylindrical member disposed in longitudinally adjustable relation, the inner member being of substantially smaller diameter than the interior surface of the outer member to provide an annular space between the two members. A collet holder extends partially into the tubular member and has an exterior cylindrical surface which fits closely within the interior surface of the tubular member. The collet includes an externally threaded outer end portion which extends longitudinally beyond the end of the tubular member and a tapered interior wall surface. A collet, made of a resilient material and having a circumferential gap therein so that it may be radially compressed against the outer surface of the outer tubular member, includes an end extending partially within the collet holder and an outer surface which is longitudinally tapered. A sleeve member having a cup-shaped end includes a circumferential ledge which engages the outer end of the collet. The sleeve also includes internal threads which threadedly engage external threads of an extension portion of the collet holder. Tightening of the sleeve onto the collet holder causes camming action between the tapered interior wall of the collet holder and the outer tapered surface of the collet, which in turn causes radial compression of the interior wall of the collet whereby the collet tightly grips the tubular member and at the same time, directs a radially outward force against the collet holder. All of the radial forces which hold the extendable inner cylindrical member at a desired position with respect to the tubular member are directed about a single relatively narrow band generally defined by the camming surfaces of the collet and collet holder. While this type of highly localized gripping action is satisfactory for supporting a relatively light-weight fan (as disclosed by Fang), it would not be expected to provide adequate gripping of a pipestand on which a seating member of a chair is mounted, particularly if a person is seated in the chair. Specifically, under the axial and radial loads imposed by a person seated in such a chair, the highly localized gripping action about a single relatively narrow band might be expected to provide a connection which wobbles as a person shifts their weight in the chair. Therefore, the connection assembly disclosed by Fang, and obvious modifications thereof, would not be well suited for use as a chair base connection assembly for securing a pipestand to a chair base.

SUMMARY OF THE INVENTION

This invention concerns an improved chair base connection assembly having a simple, inexpensive, light-weight, durable design which permits improved accurate positioning of a standpipe in a chair hub while avoiding the necessity for close manufacturing tolerances. The connection assembly is easily assembled and disassembled, includes relatively few parts which are easily manufactured, and provides a sturdy, wobble-free connection between the standpipe and the chair base.

In accordance with one aspect of the invention, the foregoing advantages are achieved by a chair base connection assembly including an inner sleeve, an outer sleeve, and an intermediate nut. The outer sleeve includes opposing radially outwardly flared ends having internally flared surfaces. An upper end of the inner sleeve includes an outer tapered surface which engages the inner tapered surface at an upper end of the outer sleeve. The intermediate nut includes an outer tapered surface which engages the inner tapered surface at the lower end of the outer sleeve, and an interior threaded surface which engages external threads at a lower end of the inner sleeve. Camming action between the outer flared surface of the inner sleeve and the inner flared surface of the upper flared end of the outer sleeve causes radial compression of the inner sleeve causing the inner surface of the inner sleeve to tightly grip the exterior surface of the pipestand in the vicinity of the upper flared end of the outer sleeve, as the intermediate nut is tightened. At the same time, camming action between the outer tapered surface of the intermediate nut and the inner tapered surface at the lower end of the outer sleeve causes radial compression of the inner sleeve which causes the inner sleeve to tightly grip the pipestand at the vicinity of the lower flared end of the outer sleeve. By gripping the stand pipe at two axially spaced apart locations, a more stable and more secure, wobble-free connection between the chair hub and the stand pipe is achieved.

BRIEF DESCRIPTION OF THE DRAWINGS

FIG. 1 is a perspective view of a chair having a base, stand pipe, and base connection assembly in accordance with the invention;

FIG. 2 is an elevational view in partial cross section of the base of the chair shown in FIG. 1;

FIG. 3 is an enlarged, fragmentary, vertically cross-sectional view of the hub portion of the base shown in FIG. 2; and FIG. 4 is an exploded, perspective view of the component parts of the chair base connection assembly.

DESCRIPTION OF THE PREFERRED EMBODIMENTS

In FIG. 1, there is shown a chair 10 having a seating member 12 including a seat portion 14 and a back portion 16. The seating member 12 is mounted on the upper end of a pipestand 18. pipestand 18 is mounted within the hub of a base 20 having a plurality of legs 22, each of which includes a caster 24.

The chair base connection assembly, or hub 26, is shown in greater detail in FIGS. 2–4. The chair base connection assembly 26 includes an outer sleeve 28, an inner sleeve 30, and an intermediate nut 32. With particular reference to FIG. 3, outer sleeve 28 includes a substantially cylindrical central portion 34, an upper flared portion 36 having an upwardly increasing radius, and a lower flared portion 38 having a downwardly increasing radius. With the illustrated embodiment, the outer sleeve 28 is approximately symmetrical in shape with respect to any vertical plane passing through the axis of the sleeve 28, and also with respect to a horizontal plane midway between the upper and lower ends of the sleeve 28. Inner sleeve 30 includes a central tapered bore 40 having a downwardly decreasing diameter. More specifically, bore 40 is tapered in accordance with industry standards, wherein the angle between a vertical line and a line defined by the intersection between a line parallel with the axis of inner sleeve 30 and a line defined by the intersection of the inner surface of inner sleeve 30 and a plane including the longitudinal axis of the inner sleeve is about 1 degree, 26 minutes and 16 seconds. Inner sleeve 30 includes a lower tubular portion 42 having a substantially constant outer diameter along its length, and an upper flared portion 44 having an upwardly increasing outer diameter. The outer surface of the upper flared portion 44 is flared at approximately the same angle as the inner surface of the upper flared portion 36 of outer sleeve 28, such that when inner sleeve 30 is inserted into outer sleeve 28, the outer surface of the upper flared portion 44 of inner sleeve 30 engages the inner surface of the upper flared portion 36 of outer sleeve 28. Intermediate nut 32 includes internal threads 33 which threadingly engage external threads 48 at the lower end of inner sleeve 30. Intermediate nut 32 also includes an externally flared or frustoconical surface 50 which engages the inner surface of lower flared portion 38 of outer sleeve 28.

Outer sleeve 28 is preferably made of a relatively rigid, unyielding material, such as steel. Legs 22 can be welded or attached to outer sleeve 28 in generally in suitable manner. Inner sleeve 30 and intermediate nut 32 are preferably made of a relatively tough plastic material such as nylon.

Attachment of a pipestand 18 to base 20 using the chair base connection assembly of the invention is simple and does not require that the components of the assembly be manufactured within the extremely close tolerances required for conventional base connection assemblies. In order to connect the pipestand 18 to the base 20, inner sleeve 30 is inserted into the central bore of outer sleeve 28 with the flared end of inner sleeve 30 facing upwardly. Intermediate nut 32 is then partially threaded onto the inner sleeve 30. Thereafter, pipestand 18 is loosely inserted into the central bore of inner sleeve 30 and intermediate nut 32 is tightened. As nut 32 is tightened, the outer flared surface 50 of nut 32 is cammingly engaged by the inner surface of lower flared portion 38 of outer sleeve 28. At the same time, the outer flared surface of upper flared portion 44 of inner sleeve 30 is cammingly engaged by the inner flared surface of upper flared portion 36 of outer sleeve 28. Camming engagement between nut 32 and lower flared portion 38 causes axial compression of inner sleeve 30 adjacent to nut 32, which in turn causes inner sleeve 30 to tightly grip pipestand 18 in the area adjacent to nut 32. Likewise, the camming engagement between upper flared portion 44 of inner sleeve 30 and the upper portion 36 of outer sleeve 28 causes axial compression of inner sleeve 30 in the area adjacent to upper flared portion 44 of inner sleeve 30 and upper flared portion 36 of outer sleeve 28, which in turn causes inner sleeve 30 to tightly grip pipestand 18 in the area adjacent to upper flared portion 44 of the inner sleeve 30. By allowing pipestand 18 to be loosely into the chair base connection assembly of the invention and subsequently locked in place by tightening the tapered intermediate nut 32, an exceptionally stable, wobble-free connection between the base and the pipestand can be achieved while allowing greater dimensional variability in the components comprising the chair base connection assembly. The chair base connection of the invention can be easily disassembled by merely loosening the tapered intermediate nut 32 and thereafter lifting the pipestand 18 from the central tapered bore 40 of inner sleeve 30. This is a significant improvement over conventional chair base connection assemblies wherein it is often difficult to force the pipestand from the precision machine tapered bore.

It will be apparent to those skilled in the art that various modifications to the preferred embodiment of the invention as described herein can be made without departing from the spirit or scope of the invention as defined by the appended claims.

The embodiments of the invention in which an exclusive property or privilege is claimed are defined as follows:

1. A chair base connection assembly, comprising:

an outer sleeve;

an inner sleeve;

an intermediate nut, the inner sleeve including a tapered inner diameter for engaging a tapered stand pipe, an outer surface having a taper at one end for engaging the outer sleeve, and a threaded section at another end for engaging the intermediate nut; and wherein the outer sleeve includes an upper flared portion having an upwardly increasing radius and a lower flared portion having a downwardly increasing radius, and wherein the nut includes an outer flared surface which matingly engages an inner flared surface on the lower flared portion of the outer sleeve.

2. The assembly of claim 1, wherein the outer sleeve is made of steel.

3. The assembly of claim 2, wherein the inner sleeve is made of plastic.

4. The assembly of claim 3, wherein the intermediate nut is made of plastic.

5. A chair base connection assembly, comprising:

an outer sleeve having upper and lower flared ends;

an inner sleeve having an upper flared portion with an outer flared surface which engages an inner flared surface on the upper flared end of the outer sleeve and having a threaded portion in a lower outer surface;

an internally threaded nut which engages the threaded portion and which has an externally tapered surface which engages an inner tapered surface on the lower flared end of the outer sleeve; and wherein the upper flared end of the outer sleeve has an upwardly increasing radius and the lower flared end of the outer sleeve has a downwardly increasing radius, and wherein the nut includes an outer flared surface which matingly engages an inner flared surface on the lower flared end of the outer sleeve.

6. The assembly of claim 5, wherein the outer sleeve is made of steel.

7. The assembly of claim 6, wherein the inner sleeve is made of plastic.

8. The assembly of claim 7, wherein the intermediate nut is made of plastic.

9. A chair, comprising:

a base;

a seat mounted on a pipestand;

a chair base connection assembly including an outer sleeve, an inner sleeve and an intermediate nut, the inner sleeve including a tapered inner diameter for engaging a tapered stand pipe, an outer surface having a taper at one end for engaging the outer sleeve, and a threaded section at another end for engaging the intermediate nut; and wherein the outer sleeve includes an upper flared portion having an upwardly increasing radius and a lower flared portion having a downwardly increasing radius, and wherein the nut includes an outer flared surface which matingly engages an inner flared surface on the lower flared portion of the outer sleeve.

10. The chair of claim 9, wherein the outer sleeve is made of steel.

11. The chair of claim 10, wherein the inner sleeve is made of plastic.

12. The chair of claim 11, wherein the intermediate nut is made of plastic.

* * * * *

UNITED STATES PATENT AND TRADEMARK OFFICE

CERTIFICATE OF CORRECTION

PATENT NO. : 5,791,611
DATED: August 11, 1998
INVENTOR(S) : Robert J. Battey; Kurt R. Heidmann It is certified that error appears in the above-identified patent and that said Letters Patent is hereby corrected as shown below:

*Column 1, line 26;

"which" should be --while--.

*Column 3, line 39;

After "generally", delete the word "in".

Column 4, line 3;

After the word "loosely", insert the word --inserted--.

Signed and Sealed this

Ninth Day of February, 1999

*Attest:*

*Acting Commissioner of Patents and Trademarks*

*Attesting Officer*